United States Patent [19]

Enzenauer et al.

[11] 4,090,689

[45] May 23, 1978

[54] APPARTUS FOR SUPPORTING AND TRANSPORTING GYMNASTIC EQUIPMENT

[76] Inventors: Sharon Sue Enzenauer, 9556 Parklane, Ladue, 63124; Donna Jean Schaeffer, 2020 St. Clair Ave., Brentwood, Mo. 63144

[21] Appl. No.: 678,025

[22] Filed: Apr. 19, 1976

[51] Int. Cl.[2] ..... B66F 7/14

[52] U.S. Cl. ..... 254/7 R; 254/89 R

[58] Field of Search ..... 254/2 R, 7 R, 8 R, 9 R, 254/89 R, 89 M, 122, 133, 134, 1, DIG. 4

[56] References Cited

U.S. PATENT DOCUMENTS

| | | | |
|---|---|---|---|
| 450,570 | 4/1891 | Hammer | 254/89 R |
| 1,014,801 | 1/1912 | Beard | 254/DIG. 4 |
| 1,576,721 | 3/1926 | Conrad | 254/122 |
| 2,546,425 | 3/1951 | Broeker | 254/122 |
| 2,724,572 | 11/1955 | Weinberg | 254/89 H |
| 2,903,258 | 9/1959 | Jovanovich | 254/DIG. 4 |
| 3,559,981 | 2/1971 | Abshear | 254/134 |

*Primary Examiner*—Robert C. Watson
*Attorney, Agent, or Firm*—Charles B. Haverstock

[57] ABSTRACT

An apparatus for supporting and transporting gymnastic equipment such as uneven parallel bar assemblies, including a wheeled frame-like structure and lifting devices thereon having associated therewith members for engaging a bar portion of a device to be lifted and transported, the lifting devices being adjustable to raise the gymnastic equipment or the like off of the floor, support it in an elevated condition while it is being transported and stored, and lower it when it is desired to reinstall it for use.

17 Claims, 7 Drawing Figures

APPARTUS FOR SUPPORTING AND TRANSPORTING GYMNASTIC EQUIPMENT

Various devices are known for lifting and transporting gymnastic and like equipment, including equipment such as uneven parallel bar assemblies. The known devices for the most part have been awkward to use, have required more than one person in their operation, have been expensive, and have had multiple and usually separate parts, all of which represent disadvantages and shortcomings. Also, the known devices, because of the way they have engaged and supported the equipment thereon, have been ustable and their instability is increased when they are supporting gymnastic equipment thereon. This is particularly undesirable when supporting gymnastic equipment such as uneven parallel bar assemblies which are relatively awkward devices that are difficult to handle and difficult to install and take down. Other problems of the known devices are that they are unwieldy and awkward to use, they require that the person using them stoop down and work beneath the parallel bar assemblies, which places that person in a dangerous position, especially if the apparatus should topple over or collapse at a time when it is either being attached or detached from the floor or from the temporary support means therefor. These problems also exist with the known devices at the time they are being operated to raise gymnastic equipment off of the floor or to lower it into contact with the floor. This is because such transporters, due to their construction, fail to adequately stabilize the assemblage, and do not have sufficient safeguards to prevent toppling. This is partly due to the fact that the known transporters are relatively low devices with relatively narrow wheel bases and for the most part they engage and support the parallel bar assemblies at or near their bases so that they are relatively easy to overturn. This easy to understand when it is remembered that uneven parallel bar assemblies are relatively high devices and therefor relatively slight force applied near the top of them when they are being supported can cause them to become unstable and to overturn or collapse.

The present invention teaches the construction of a frame-like structure that has a relatively wide base and a relatively high structure or profile so that it supports and lifts the gymnastic equipment at a point some distance above the floor and near the top of the equipment being supported, thereby making for a relatively stable support structure and one which eliminates or minimizes the instability and toppling problems encountered with known devices used for this purpose. No known transporters for gymnastic equipment and particularly for uneven parallel bar assemblies have all of these characteristics. In addition, the present construction is a single unit device as opposed to a multi unit device and is therefore easier and less awkward to use, and the present device provides a safer, less expensive, more convenient, and simple means to raise and lower awkward gymnastic equipment and to store, transport, and otherwise handle such equipment. Furthermore, the present device makes it possible for a single gymnast to be able to install and take down complicated uneven parallel bar assemblies, and to do so quickly and safely. No other known transporter device offers these advantages.

It is therefore a principal object of the present invention to provide a new type of device that is particularly suitable for transporting and supporting gymnastic equipment, including especially uneven parallel bar assemblies such as are used by gymnasts.

Another object of the present invention is to provide a device for transporting and supporting gymnastic equipment, including especially uneven parallel bar assemblies, which, when it has gymnastic equipment mounted and supported thereon, has good stability characteristics and is difficult to overturn or topple.

Another object is to provide device for conveniently holding and storing gymnastic equipment, including especially uneven parallel bar assemblies.

Another object is to provide a device that can be used for transporting, supporting, and for storing gymnastic equipment, including especially uneven parallel bar assemblies.

Another object is to provide a transporter-supporter for gymnastic equipment which offers improved safety and convenience factors.

Another important object is to provide a transporter-supporter device for transporting and supporting gymnastic equipment which can be operated safely even by a single person.

Another object is to provide a transporter-supporter device for transporting and supporting gymnastic equipment, including especially uneven parallel bar assemblies, that is relatively inexpensive and easy to construct.

Another object is to simplify the procedure used to install and to take down complicated and cumbersome gym equipment.

Another object is to provide means to accurately locate and support guyed structures such as guyed uneven parallel bar assemblies when attaching and detaching the various parts thereof to a gym floor.

These and other objects and advantages of the present invention will become apparent to those skilled in the art after considering the following detailed specification covering preferred embodiments thereof in conjunction with the accompanying drawings, wherein.

Figure 2:
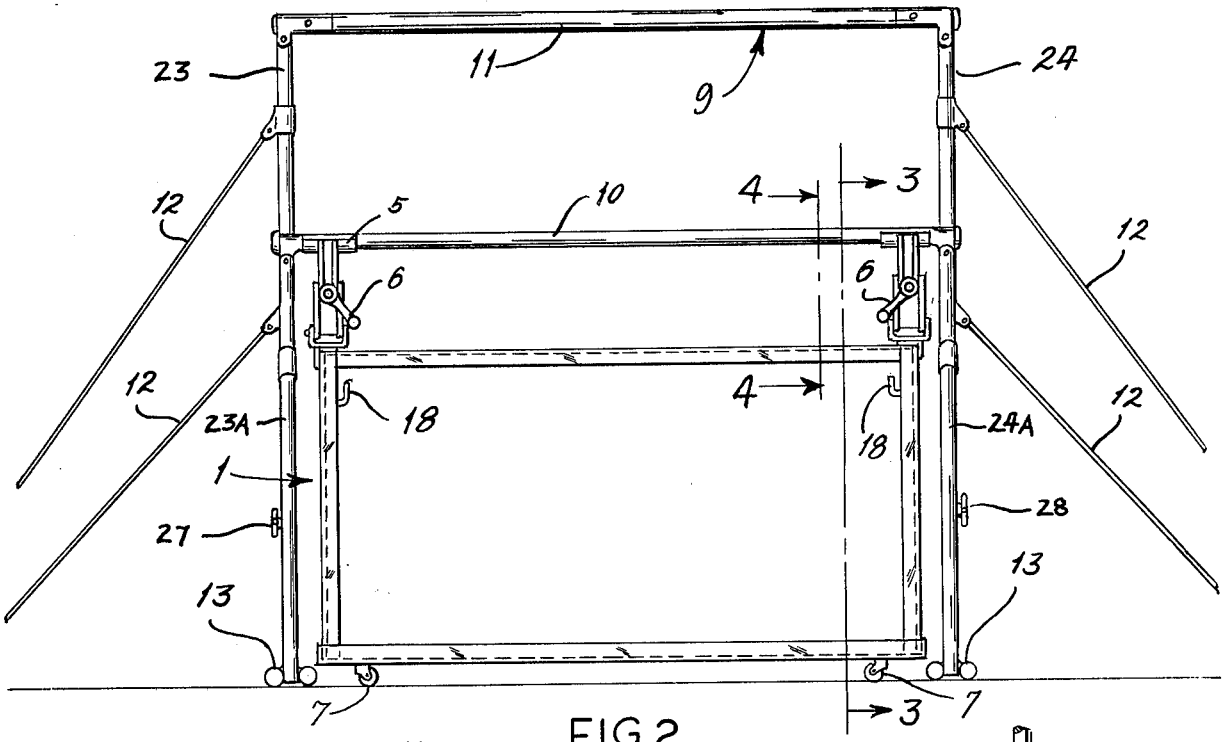
FIG. 2 is a side elevational view of the subject device engaging a partially dismounted uneven parallel bar assembly that is connected to the floor by guy means.
Figure 6:
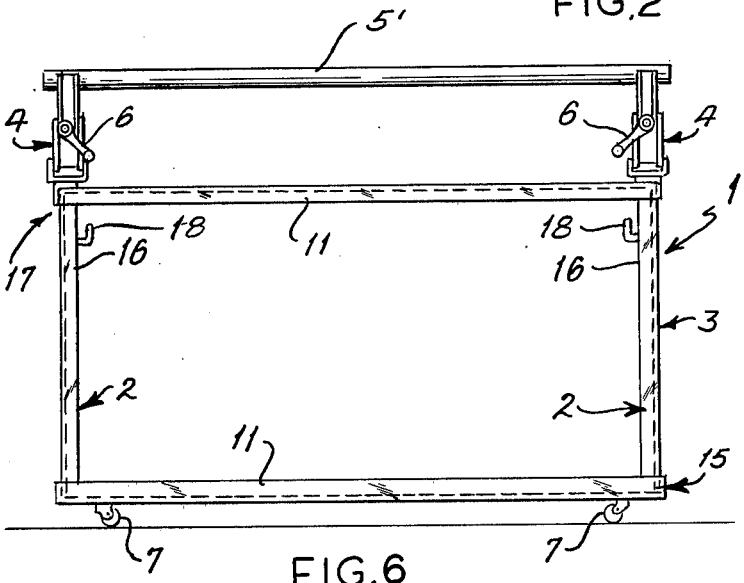
Figure 3:
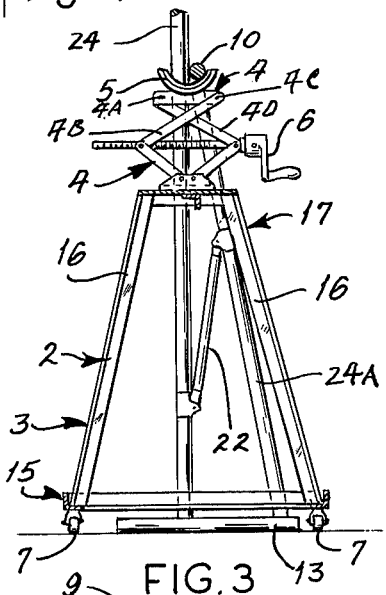
FIG. 3 is a cross-sectional view taken on line 3—3 of FIG. 2.
Figure 7:
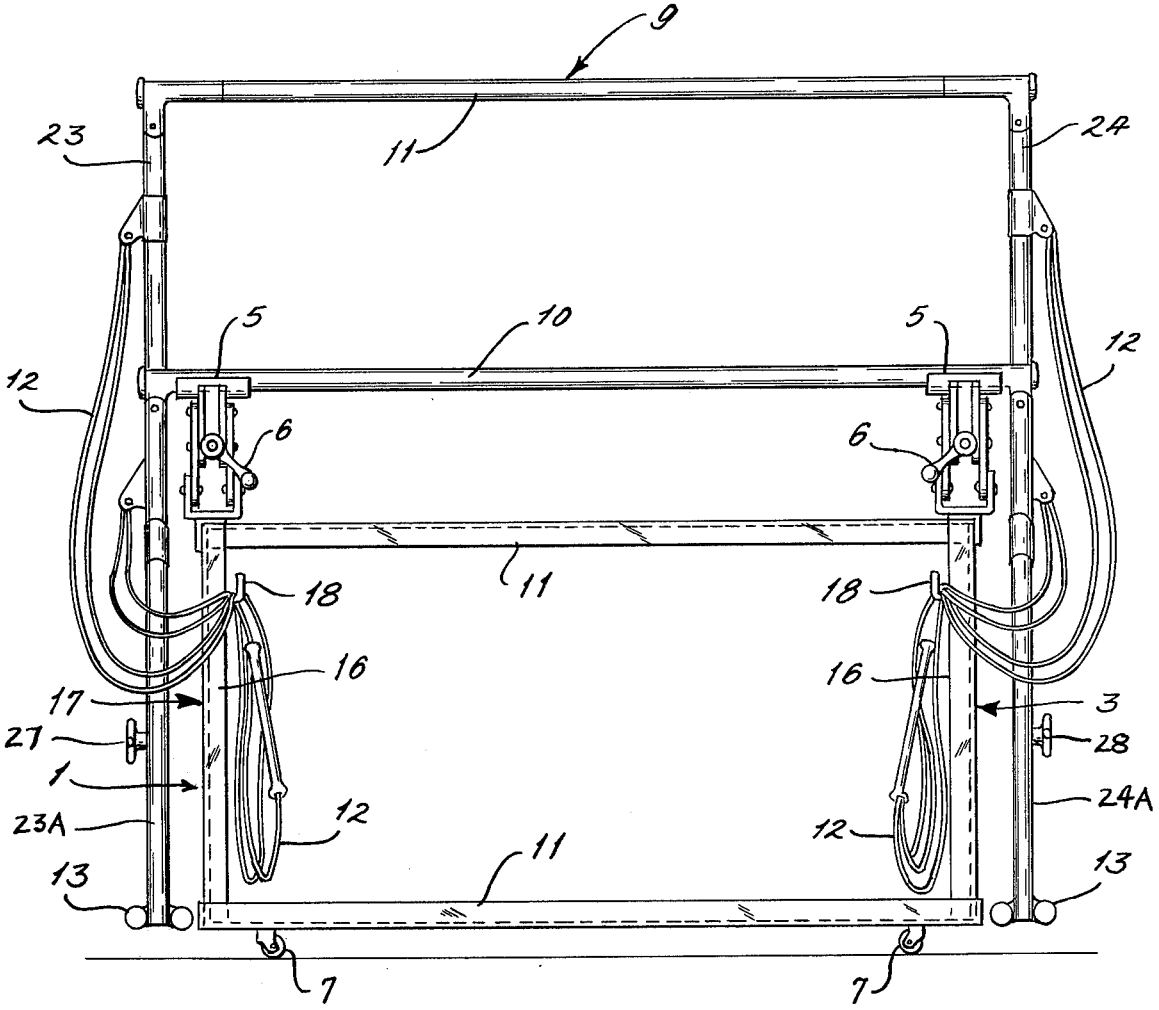

FIG. 6 is a side elevational view of a somewhat modified embodiment of a transporter-supporter device constructed according to the present invention, said device having a single rail engaging member associated with two spaced jack members; and, FIG. 7 is a side elevational view similar to FIG. 2 but showing the uneven parallel bar assembly fully mounted upon and supported by the transporter-supporter.

Referring to the drawings more particularly by refernce numbers, number 1 identifies a device for supporting and transporting gym equipment constructed according to the present invention, and particularly devised for use with uneven parallel bar assemblies and the like. The device as shown has a frame-like structure 3 including spaced and oppositely disposed end frame portions 2 connected by frame members 11 which extend therebetween. The frame structure, as will be explained, has a lower frame portion which is relatively wide in relation to the upper portion of the frame and is connected thereto by the end frame portions 2, as will be described. The upper portion of the frame assembly 1 has a pair of spaced jack assemblies 4 mounted thereon near or adjacent to the end portions 2. Each of the jack assemblies 4 has a hand crank 6 which is operated to raise and lower an associated channel shaped member 5 mounted on the upper portion or member 4A of the respective jack assembly 4. The jacks 4 can be of a known scissors type construction wherein when the respective cranks 6 are turned in one direction they will cause the upper jack portion 4A to move upwardly and when rotated in the opposite direction will lower the upper portion 4A. In the usual situation the member 4A is pivotally connected to the upper end of one of the scissor jack members 4B at 4C, and the opposite end of the member 4A is slideable on the other upwardly extending scissor member 4D. As a safety feature to prevent the members 4A from overturning on the respective jacks especially when loaded, a cord such as cord 4E (FIG. 4) which is knotted at both ends, is positioned extending through holes in the respective members 4A and 4D as shown.

The whole frame structure 1 is supported for movement over the floor of a gym or other surface on a plurality of spaced wheel assemblies 7. It is to be noted that the wheel assemblies 7 are mounted on opposite sides of the lower portion of the frame assembly, and therefore the wheels 7 are relatively far apart making it relatively difficult to overturn the subject framework and substantially contributing to the stability and safety of the present construction. However, the number of wheel assemblies 7 can be increased if desired.

The structure 3 may alternatively be viewed as having a base portion 15, including wheel assemblies 7 supporting the structure, with side frame portions 16 extending upwardly from the base portion 15 to form an upper structure portion 17. In the preferred embodiment the base portion 15 is relatively wide in comparison to the upper portion of the frame structure 3 to provide a more stable device 1. The jack assemblies are preferably also mounted on top of the upper structure portion 17 adjacent opposite ends thereof.

Figure 5:
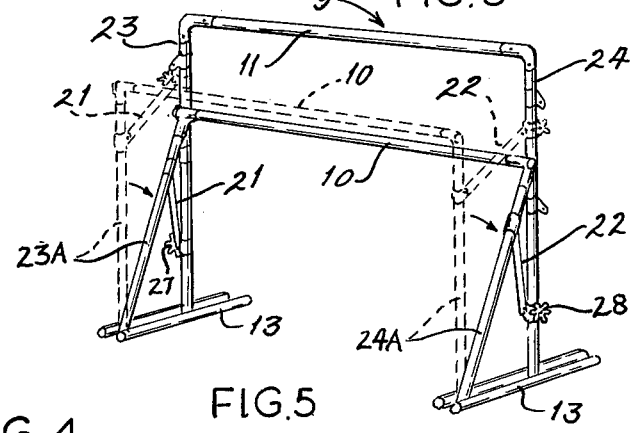
FIG. 5 is a perspective view of the partially dismounted uneven parallel bar assembly of FIG. 2, showing the lower bar fully erected in dotted outline, and in collapsed condition in solid outline, said assembly being shown without the guy wires therefor for ease of understanding.

The length of the subject transporter-supporter device 1 is selected to be somewhat less than the distance between the side uprights 23 and 24 (23A and 24A) of the gymnastic equipment 9 to be elevated and supported thereby during transport or storage (FIG. 5). Also, the heighth of the subject device is such that when the jack assemblies 4 are positioned to be in a lowered position thereon, the transporter-supporter including the channel shaped members 5 can be moved to a position underneath the gymnastic equipment that is to be transported and supported, preferably with the channel shaped members 5 positioned beneath the lower bar 10 of the uneven parallel bar assembly. This can be done when the assembly 9 is fully erected and installed or when the assembly 9 is partially dismounted (such as is shown in FIG. 5).

Referring to FIG. 5, there is shown in dotted outline an erect uneven parallel bar assembly 9 minus the guy wires therefor. In the fully erect position, parallel bars 10 and 11 are maintained a fixed distance apart by width adjustment bars 21 and 22, which may be locked in position by T-handles 27 and 28. In order to prepare the uneven parallel bar assembly for engagement with the transporter-suppoter construction 1, the T-handles 27 and 28 are loosened and bars 21 and 22 are positioned and locked in position by retightening T-handles 27 and 28 so that the bar 10 abuts the longer uprights 23 and 24 that support the upper bar 11, as shown in solid outline in FIG. 5. This can be done either before or after the subject transporter-supporter device is positioned underneath the assembly 9, but before engagement with the transporter-supporter device. The assembly 9 will remain in this state after engagement with the subject transporter-supporter device but will tilt to a certain extent in order to seek a normal suspended condition on the subject device as the assembly 9 is lifted off the floor, as will be explained.

Figure 4:
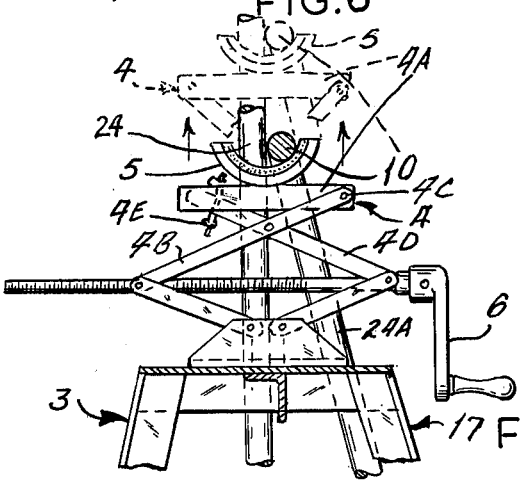
FIG. 4 is an enlarged, fragmentary, cross-sectional view of a jack assembly used on the subject transporter-supporter device taken on line 4—4 of FIG. 2, said jack assembly being shown in a lowered position in solid outline and in an elevated position in dotted outline.

After partially collapsing the uneven parallel bar assembly 9 and with the jack assemblies 4 in lowered positions, the channel shaped members 5 can be positioned under the lower bar 10 of the uneven parallel bar assembly 9 as shown in FIG. 4, for example. When the device is in this position, the hand cranks 6 of the respective jack assemblies can be rotated to move the respective channel shaped members 5 upwardly into engagement with the lower bar 10. This can be done without putting any stress on the bar 10, and in this position, because of the shape of the channel shaped members 5, the subject device is able to support the uneven parallel bar assembly while it is being released or detached from the floor, as will be described, or while it is being reattached to the floor. While the device is in the engaging position described (FIG. 2), the usual guy wires, such as guy wires 12, which support the uneven parallel bar assembly in its fully erect condition can be released from their connections to the floor in the usual manner, such as by releasing snap connections and related floor anchoring means provided therefor (shown only generally in FIG. 7) and detaching the connectors from the floor mounting plates (not shown). This can be done in relative safety because the subject device is positioned engaging the lower bar 10 of the assembly and providing support for the whole assembly 9. When the guy wires have been detached from the floor they can be draped over or hooked onto hook members 18 provided therefor on the subject frame structure, as shown in FIG. 7, for convenience in handling and moving the device.

After the uneven parallel bar assembly has been collapsed in the manner described and the guy cables 12 have been detached from the floor, the crank handles 6 are turned in a direction to further raise the parallel bar assembly off of the floor to a more or less free swinging or suspended condition on the subject construction. Note that it is not necessary to provide any other means for attaching or supporting the uneven parallel bar assembly on the subject device. This is because during the detaching (or attaching) operation the uneven parallel bar assembly 9 is supported in a stable condition by the subject device. After the uneven parallel bar assembly has been raised clear of the floor, the apparatus with the uneven parallel bar assembly supported thereon can then be rolled across the floor or other surface to any desired location, where the apparatus can be stored or reinstalled or removed from the subject device. If desired, the uneven parallel bar assembly can remain on the subject device indefinitely in a safe storage condition.

The transporter-supporter device 1 may also be used in an alternate manner to dismount or erect uneven parallel bar assemblies. In the alternate method the transporter-supporter 1 is positioned beneath a fully erect uneven parallel bar assembly such as is shown in dotted outline in FIG. 5. The device is positioned such that when the cranks 6 of the respective jack assemblies 4 are rotated to raise the channel shaped members 5, these members move into engagement with the lower bar 10 of the parallel bar assembly as aforesaid. When the bar 10 has been fully engaged by channel shaped members 5 the tension on the guy cables 12 is relaxed by releasing the snap connections provided therefor, and the connectors are detached from the floor mounting plates therefor, and the guy cables 12 are stored on hooks 18. In this condition the device 1 is able to support the uneven parallel bar assembly while it is being further configured for dismounting and transporting, as already explained, because of the shape of the channel shaped members 5.

With the transporter-supporter in position to so support the parallel bar assembly 9, the T-handles 27 and 28 are loosened and the width adjustment bars 21 and 22 are positioned such that the longer uprights 23 and 24 for upper bar 11 are moved to adjacent the lower bar 10, which is resting in and being supported by channel shaped members 5. T-handles 27 and 28 are thereafter retightened to lock width adjustment bars 21 and 22 in place, and cranks 6 are then operated to further raise the channel shaped members 5 and the assembly 9 supported thereby. As the base portions 13 of the assembly 9 are raised off of the floor the assembly will swing slightly as the assembly seeks a state of equilibrium upon transporter-supporter 1. The shape of the channel shaped members 5 allows lower bar 10 to roll slightly within the members while seeking equilibrium and the wide base and high profile of the transporter-supporter 1 provide a stable platform that prevents toppling of the device with the parallel bar assembly supported thereon. The uneven parallel bar assembly can be reerected by reversing the steps of this procedure.

It is important to the invention that, regardless of the method employed, the entire operation of the subject device as a means for removing the gym equipment from the floor or reinstalling it can be accomplished both quickly and safely by a single individual without any help from another individual, and the same is true regardless of whether the uneven parallel bar assembly is being erected or is being taken down for storage or for transporting to another location.

In the preferred embodiment of the present device, the frame structure 3 has an open construction, which is desirable because it reduces its weight and makes it easy to handle. A frame-like construction is also relatively inexpensive to construct, requires relatively little material, is easy to handle and control when moving, and is more convenient to work with than would be a more solid or closed structure. A frame-like construction also has greater accessibility. The structure 3 is preferably constructed using angle iron members or members of other suitable materials, and the members used in the construction of the present device must be strong enough to support the load. It will be apparent, however, that various configurations of the subject construction and the use of many different materials are possible and contemplated for the present device.

Figure 1:
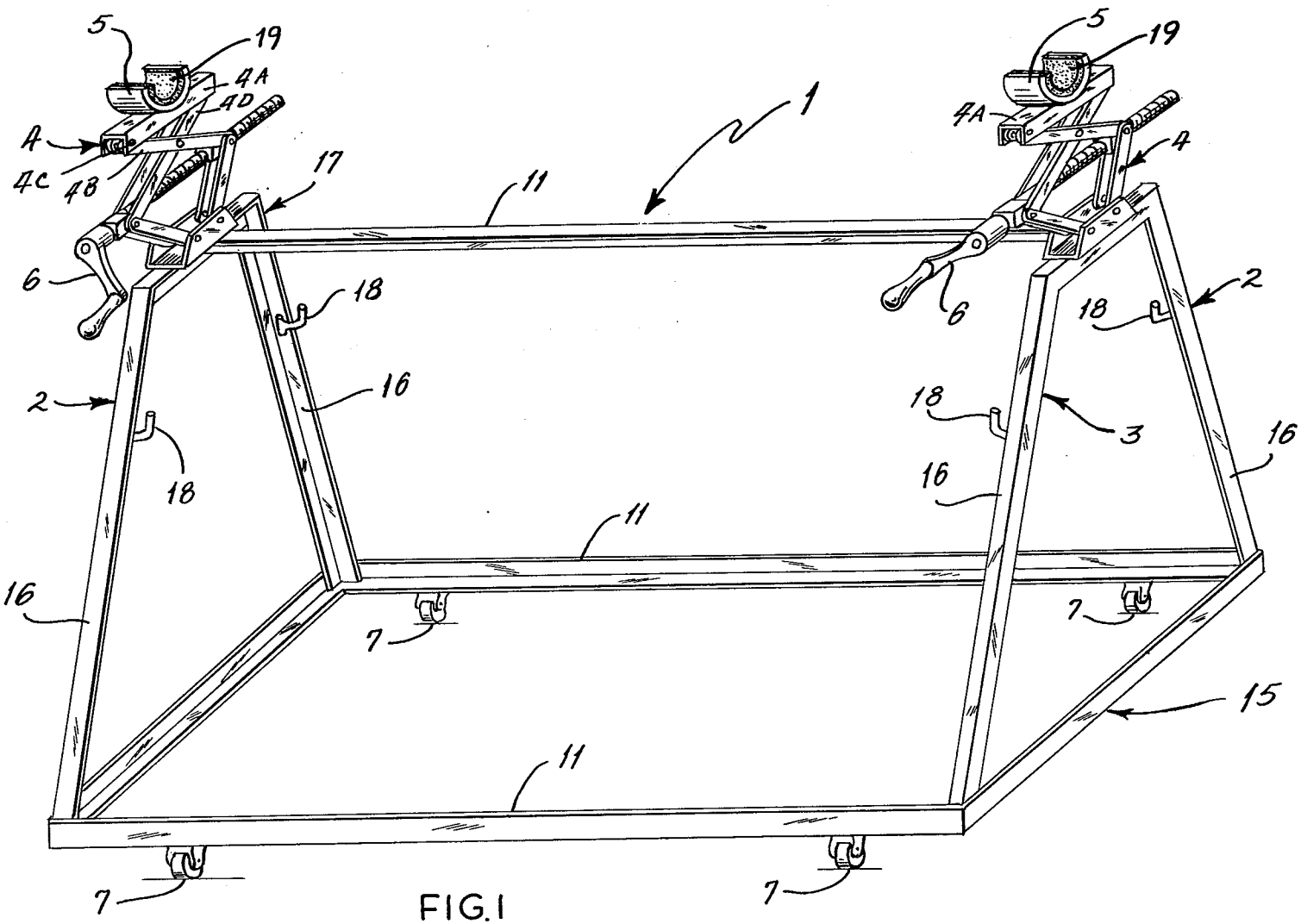
FIG. 1 is a perspective view of the transporter-supporter device constructed according to the teachings of the present invention.

It is also possible to use other types of jack assemblies mounted atop opposite ends of the construction although the scissors type jacks disclosed herein are relatively economical and reliable. It is also desirable to provide two separately operable jack members since this permits opposite ends of the parallel bar apparatus to be separately elevated and to be elevated to different heights if desired or required. It is also contemplated to provide two spaced jack members connected by a single elongated channel shaped member 5' to provide support along a substantial length of the bar 10 of the assembly 9 as shown in FIG. 6. It is also preferred to provide liners such as the liner 19 for the channel shaped members 5 (FIG. 1). The liners 19 are preferably constructed of a yieldable material, such as rubberized or plastic-like material so that the bar being supported will not be scratched or otherwise marked by the channel shaped members and so that the bar will be cushioned while supported. All of the channel shaped members shown have liners such as the liner 19 positioned therein for the reasons stated.

While the subject invention has been described primarily for use in erecting, dismounting, supporting, and transporting uneven parallel bar assemblies, it will be recognized that its use is not restricted to such assemblies, but extends to the other gymnastic and related equipment, including especially equipment that includes one or more horizontal bar portions which can be positioned extending between and supported by members such as the channel shaped members 5. It is also expected that some adjustment in the height of the bars that are engaged and supported in the channel shaped members may be necessary, but this is usually easily done and provision is ordinarily made on the uneven bar assemblies and other types of similar assemblies, such as high bar assemblies and the like, which make the vertical height adjustment relatively easy to accomplish. The present apparaus can also be used to transport gym equipment wherein the horizontal bar members are vertically adjustable on the respective spaced column members by means attached to the upper end of column members which are adjustable by being telescoped within the column members. The details of the particular construction to be transported are not a part of the present invention, but it should be recognized that the present construction is adaptable to support many different kinds of such devices. The invention is therefore especially suitable for supporting and transporting gymnastic equipment characterized by having two oppositely disposed end portions with cross members extending therebetween. This includes items such as high bars and various kinds of parallel bar assemblies, and other like structures which can be supported in a stable condition by being suspended.

Thus there has been shown and described a novel transporter-supporter device especially for transporting and supporting gymnastic equipment, including especially uneven parallel bar assemblies such as are used by gymnasts, which device fulfills all of the objects and advantages sought therefor. It is apparent, however, that many changes, modifications, variations and other uses and applications of the subject device are possible and all such changes, modifications, variations, and other uses and applications which do not depart from the spirit and scope of the invention are deemed to be covered by the invention which is limited only by the claims which follow.

We claim:

1. An apparatus for storing and transporting thereon in a suspended condition gymnasium equipment such as an uneven parallel bar assembly having a bar-like member near its top, comprising a movable structure and jack means supported thereon, said structure including means for movement on a floor-like surface supporting the structure and spaced end portions extending upwardly therefrom, said jack means positioned on the structure at a height substantially above the floor-like surface, said jack means including at least one upwardly opening channel shaped member positioned thereon for vertical movement into engagement with the bar-like member of the gymnasium equipment and adjustable to lift and support the equipment in an elevated but suspended position, said jack means being adjustable to vary the elevation of the associated channel shaped member between a lowered position spaced below the bar-like member to be lifted and an upper position that is higher than the unlifted position of the bar-like member, said structure and supported jack means being adapted to be moved when said jack means are in a lowered position to a position in which the channel shaped member is located beneath the bar-like member of the gymnasium equipment to be supported and transported so that adjustment of said jack means raises the channel shaped member to a position engaging the bar-like member and thereafter further raises the bar-like member and the gymnasium equipment of which it is a part to a suspended elevated condition above the floor for transport and storage on the structure, said structure being an open framework having frame members connecting said spaced end portions, and wherein the equipment to be supported includes guy means for attaching to a floor to maintain an erect position therefor, said structure including hook means thereon for holding and supporting said guy means when detached from the floor.

2. The apparatus defined in claim 1 wherein the jack means are scissors type jack means and include operator means movable to change the vertical position of the associated channel shaped member thereon.

3. The apparatus defined in claim 1 wherein the jack means includes a pair of spaced jack assemblies located respectively adjacent to each of the end portions of the structure.

4. The apparatus defined in claim 3 wherein each of said jack assemblies has an upwardly opening channel shaped member thereon, the equipment to be supported including an elonated bar member, said channel shaped members being aligned to engage and support the bar member on the gymnasium equipment at spaced locations therealong.

5. The apparatus defined in claim 1 wherein said channel shaped member includes cushioning means thereon.

6. The apparatus defined in claim 1 wherein said structure includes base and upper portions, said end portions connecting the base and upper portions of the structure, the base portion being substantially wider than the upper portion.

7. The apparatus defined in claim 8 wherein said means for supporting the structure for movement includes spaced wheel assemlies attached to the base portion near the ends and sides thereof.

8. Means to store and transport in a suspended condition gymnastic equipment such as uneven parallel bar assemblies which are characterized by having a pair of spaced bars located near the tops thereof each at a different elevation and guy means for attaching the assembly to a floor to maintain the assembly in an erect position, said storing and transporting means comprising a movable structure having a base portion with wheel means for movement to support it and an upper portion connected to the base portion and extending upwardly therefrom to a substantially elevated position spaced thereabove, vertically adjustable lifting means located atop the upper portion including bar engaging means associated therewith to engage one of the bars of a parallel bar assembly to be stored and transported thereon, said wheel means being located on said base portion at relatively widely spaced locations to provide a structure that is difficult to overturn, said lifting means including operator means adjustable to move the bar engaging means to a lowered position to permit said structure with the lifting means thereon to be moved to a position with said bar engaging means positioned beneath one of the bars of a parallel bar assembly, said operator means thereafter adjustable to move said associated bar engaging means upwardly into engagement with the bar to provide support for the parallel bar assembly independently for other support means therefor, and adjustable when the guy means on the assembly are released to further move said associated bar engaging means upwardly to raise the engaged bar of the parallel bar assembly and to lift the parallel bar assembly off the floor to suspend it thereabove, said storing and transporting means with the parallel bar assembly suspended thereon being movable across the floor, and means on the structure for attaching the guy means thereto when the guy means are disconnected from the floor.

9. The means defined in claim 8 wherein the bar engaging means include cushioning means.

10. The means defined in claim 8 wherein the bar engaging means includes at least one upwardly opening channel shaped member.

11. The means defined in claim 8 wherein the base portion of the structure is substantially wider than the upper portion thereof.

12. The means defined in claim 8 wherein the structure includes an open frame having spaced connected end and side frame portions, the base portion being substantially wider than other portions thereof.

13. A device for erecting and dismantling bar type gymnasium equipment including an uneven parallel bar assembly and the like that has a pair of bars located near its top, which bars are positioned at different elevations when in use, and guy means for attaching the assemblies to floor mounting plates to maintain them in an erect position, said device comprising a movable structuure having a pair of jack assemblies mounted thereon, said structure including wheel support means, a relatively wide base portion mounted upon said wheel support means, an elongated relatively narrow upper portion, and connection means extending upwardly from said base portion to connect said base portion to said upper portion, said pair of jack assemblies being mounted atop said upper portion and spaced apart from one another adjacent opposite ends thereof, each of said jack assemblies having an upwardly opening bar engaging member attached thereto, the bar engaging members on said jack assemblies being in alignment to engage spaced locations on one of the bars of the parallel bar assembly to be supported thereby, said jack assemblies including operator actuatable means adjustable for changing the vertical positions of the bar engaging members, said support structure with said jack assemblies mounted thereon being movable to position the bar engaging members under the bar to be engaged, said operator actuatable means operable thereafter to move said bar engaging members upwardly into engagement with the bar to provide support for the parallel bar assembly independently of the guy means and further operable when the guy means have been released from the floor mounting plates to elevate the bar and parallel bar assembly of which it is a part to raise the parallel bar assembly off of the floor and support it thereabove in suspended free swinging position on the bar engaging members, and means on the structure for attaching the guy means thereto when the guy means are disconnected from the floor.

14. The device defined in claim 13 wherein said means to adjust the vertical position of the respective bar engaging members include crank means operable in one direction to raise the bar engaging members and in another direction to lower the bar engaging members. means located atop the upper portion including bar engaging means associated therewith to engage one of the bars of a parallel bar assembly to be stored and transported thereon, said wheel means being located on said base portion at relatively widely spaced locations to provide a structure that is difficult to overturn, said lifting means including operator means adjustable to move the bar engaging means to a lowered position to permit said structure with the lifting means thereon to be moved to a position with said bar engaging means positioned beneath one of the bars of a parallel bar assembly, said operator means thereafter adjustable to move said associated bar engaging means upwardly into engagement with the bar to provide support for the parallel bar assembly independently of other support means therefor, and adjustable when the guy means on the assembly are released to further move said associated bar engaging means upwardly to raise the engaged bar of the parallel bar assembly and to lift the parallel bar assembly off the floor to suspend it thereabove, said storing and transporting means with the parallel bar assembly suspended thereon being movable across the floor, and means on the structure for attaching the guy means thereto when the guy means are disconnected from the floor.

15. A method for supporting an uneven parallel bar assembly having a pair of spaced bars supported by uprights and guy means to maintain the assembly in an erect condition for use comprising providing a support structure on which the uneven parallel bar assembly can be suspended including a framework of connected structural members having a relatively wide base portion supported on spaced wheel assemblies and a relatively narrow upper portion spaced above said base portion with spaced lifting devices thereon, each of said lifting devices having means for engaging with one of the bars of the uneven parallel bar assembly to be supported thereon, moving the support structure to position the bar engaging means thereof under the bar of the uneven parallel bar assembly to be supported at a time when the bar engaging means are in a lowered condition, operating the lift devices to move the respective bar engaging members upwardly into engagement with the bar of the uneven parallel bar assembly to provide support for the assembly independently of the guy means, releasing the guy means from attachment to the floor and subsequently attaching the guy means to means on the structure provided therefor, and operating the lifting devices to move the bar engaging members and the bar engaged thereby upwardly to raise the uneven parallel bar assembly of which the engaged bar is a part off of the floor and to support it in a suspended condition on the bar engaging means.

16. The apparatus defined in claim 2 wherein each of the jack means include pairs of pivotally connected crossed members including upwardly extending crossed members, a load engaging member positioned extending between and supported by the upwardly extending crossed members, said load engaging member being pivotally connected to one of said pair of crossed members and resting upon and being slideable relative to the other crossed member, and a flexible cord member to maintain said load engaging member in engagement with said other crossed member.

17. An apparatus for storing and transporting thereon in a suspended condition gymnasium equipment such as an uneven parallel bar assembly having a bar-like member near its top, comprising a movable structure and jack means supported thereon, said structure including means for movement on a floor-like surface supporting the structure and spaced end portions extending upwardly therefrom, said jack means positioned on the structure at a height substantially above the floor-like surface, said jack means including at least one upwardly opening channel shaped member positioned thereon for vertical movement into engagement with the bar-like member of the gymnasium equipment and adjustable to lift and support the equipment in an elevated but suspended position, said jack means being adjustable to vary the elevation of the associated channel shaped member between a lowered position spaced below the bar-like member to be lifted and an upper position of the bar-like member, said structure and supported jack means being adapted to be moved when said jack means are in a lowered position to a position in which the channel shaped member is located beneath the bar-like member of the gymnasium equipment to be supported and transported so that adjustment of said jack means raises the channel shaped member to a position engaging the bar-like member and thereafter further raises the bar-like member and the gymnasium equipment of which it is a part to a suspended elevated condition above the floor for transport and storage on the structure, the jack means being scissors type jack means and including operator means movable to change the vertical position of the associated channel shaped member thereon, each of the jack means including pairs of pivotally connected crossed members including upwardly extending crossed members, a load engaging member positioned extending between and supported by the upwardly extending crossed members, said load engaging member being pivotally connected to one of said pair of crossed members and resting upon and being slideable relative to the other crossed member, and a flexible cord member to maintain said load engaging member in engagement with said other crossed member.

* * * * *

UNITED STATES PATENT OFFICE

CERTIFICATE OF CORRECTION

Patent No. 4,090,689 Dated May 23, 1978

Inventor(s) Miss Sharon Enzenauer and Miss Donna Schaeffer

It is certified that error appears in the above-identified patent and that said Letters Patent are hereby corrected as shown below:

Column 1, line 13, "ustable" should be "unstable"; line 37, after "This" insert "is".

Column 2, line 9, after "provide" insert "a".

Column 3, line 2, "fernce" should be "ference".

Column 4, line 10, "-suppoter" should be "-supporter".

Column 7, line 53, "elonated" should be "elongated"; line 65,"Claim 8" should be "Claim 6"; line 67, "assemlies" should be "assemblies".

Column 8, line 27, "for" should be "of"; line 56, "structuure" should be "structure".

Column 9, line 25, delete beginning with "means located atop . . . down to and including "from the floor", in line 49.

Signed and Sealed this

*Twenty-sixth* Day of *September 1978*

[SEAL]

*Attest:*

RUTH C. MASON
*Attesting Officer*

DONALD W. BANNER
*Commissioner of Patents and Trademarks*